US005403160A

United States Patent [19]

You

[11] Patent Number: 5,403,160

[45] Date of Patent: Apr. 4, 1995

[54] FAN BLADE CONFIGURATION

[76] Inventor: Yaw-Yuh You, 58, Ma Yuan West St., Taichung, Taiwan, Prov. of China

[21] Appl. No.: 185,049

[22] Filed: Jan. 24, 1994

[51] Int. Cl.[6] ..... F01D 5/14

[52] U.S. Cl. ..... 416/223 R; 416/231 B

[58] Field of Search ..... 416/223 R, 231 R, 231 B

[56] References Cited

U.S. PATENT DOCUMENTS

| | | | |
|---|---|---|---|
| 991,134 | 5/1911 | Capell | 416/231 R |
| 1,066,988 | 7/1913 | Boutwell | 416/231 R |
| 2,169,325 | 8/1939 | Novak | 416/213 B |

*Primary Examiner*—John T. Kwon

[57] ABSTRACT

A fan blade includes a plate and a board fixed on the plate, an opening is formed in the fan blade for facilitating air circulation when the fan blade is operated. The plate and the board each includes a notch, the notches form the opening when the board is fixed on the plate.

1 Claim, 6 Drawing Sheets

FAN BLADE CONFIGURATION

BACKGROUND OF THE INVENTION

1. Field of the Invention

The present invention relates to a blade, and more particularly to a fan blade configuration.

2. Description of the Prior Art

Typical fan blades comprise a blade body having solid configuration and having no openings formed therein for circulation purposes.

The present invention has arisen to mitigate and/or obviate the afore-described disadvantages of the conventional fan blades.

SUMMARY OF THE INVENTION

The primary objective of the present invention is to provide a fan blade configuration which includes at least one opening formed therein for circulation purposes.

In accordance with one aspect of the invention, there is provided a fan blade configuration comprising a plate, and a board fixed on the plate, and at least one opening formed in the plate and the board for facilitating air circulation when the fan blade is operated.

The plate includes a first notch formed therein, the board includes a second notch formed therein, the first notch and the second notch form the opening when the board is fixed on the plate.

The plate includes a shoulder formed in either the lateral direction or longitudinal direction, and the board is fixed on the plate and engaged with the shoulder, the board includes an upper surface flush with that of the plate.

The plate includes an upper surface having a recess formed therein, the board is engaged in the recess and fixed on the plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
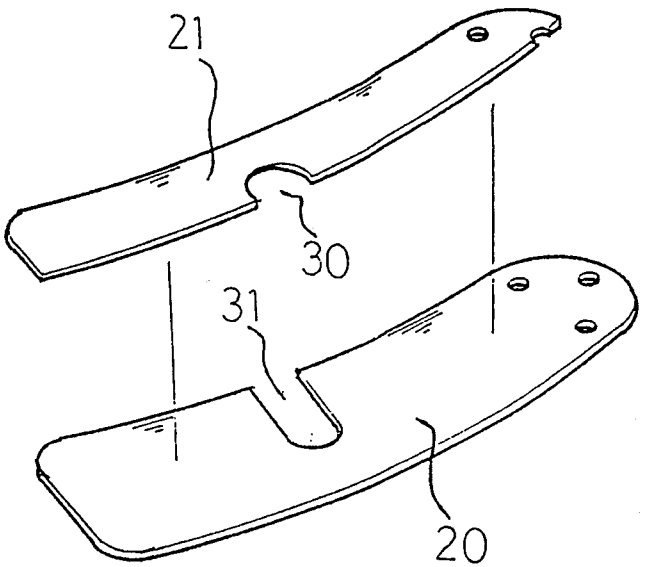
FIG. 1 is an exploded view of a fan blade in accordance with the present invention.
Figure 2:
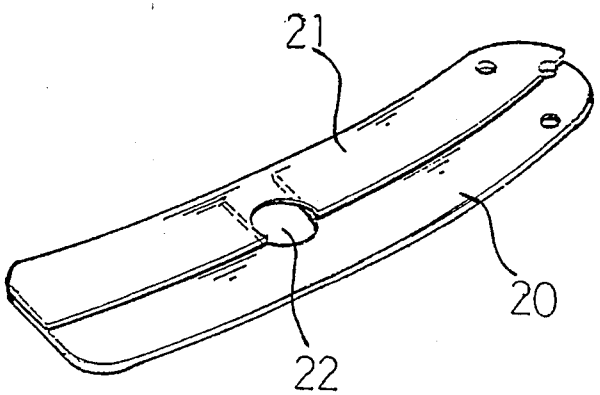
FIG. 2 is a perspective view of the fan blade.
Figure 3:
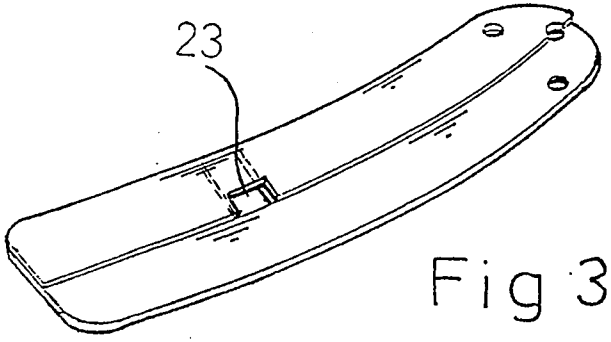
FIGS. 3, 4, 5 and 6 are perspective views of another applications of the fan blade.

Referring to the drawings, and initially to FIGS. 1 and 2, a fan blade configuration in accordance with the present invention comprises a plate 20 and a board 21 each including a middle portion having a notch 31, 30 formed therein, the board 21 includes a smaller size than the plate 20 and is secured on the plate 20 by adhesive materials and includes one longitudinal side edge coincide with one longitudinal side edge of the plate 20, the notches 30, 31 form an opening 22 when the board 21 is fixed on the plate 20. Alternatively, the opening 23 may have a rectangular shape as shown in FIG. 3.

In operation, air may flow through the opening 22, 23 such that the air circulation may be facilitated.

Figure 4:
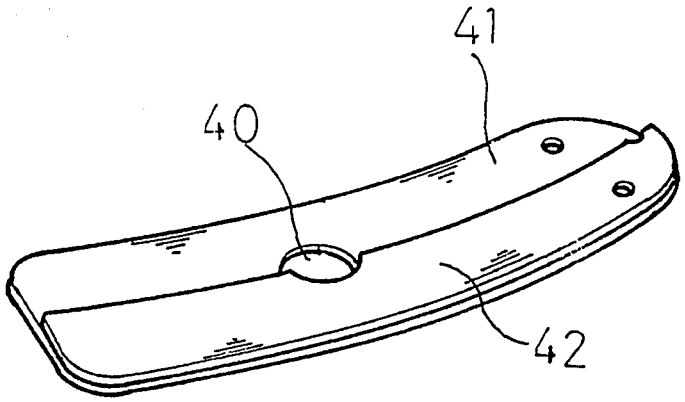

Referring next to FIG. 4, the opening 40 may be drilled or formed after the board 42 is fixed on the plate 41, and the opening 40 is formed in the middle portion of the plate 41 and the board 42 also includes a notch formed therein and communicated with the opening 40 for facilitating air circulation.

Figure 5:
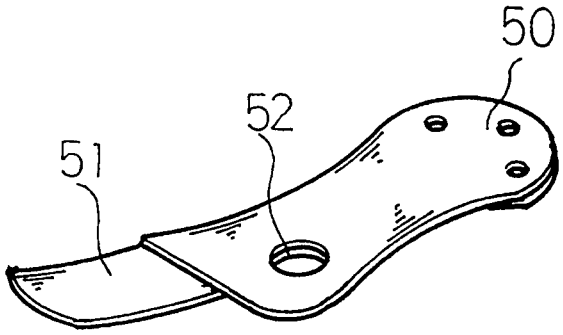
Figure 6:
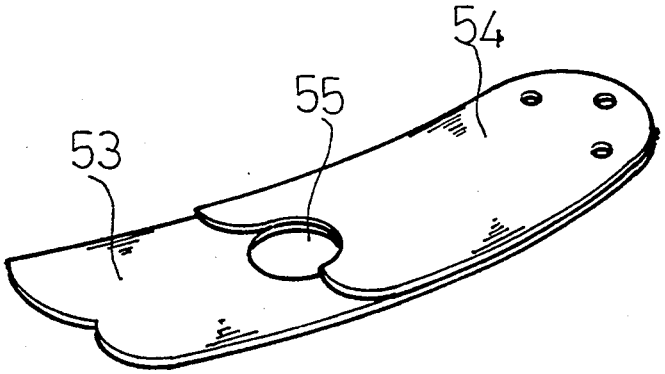

Referring next to FIG. 5, the plate 51 may be longer than the board 50 and may be narrower than the board 50, and an opening 52 is formed in the middle portion of the whole fan blade. As shown in FIG. 6, another type of fan blade is shown and includes a board 54 fixed on a plate 53 and has an opening 55 formed therein.

Figure 7:
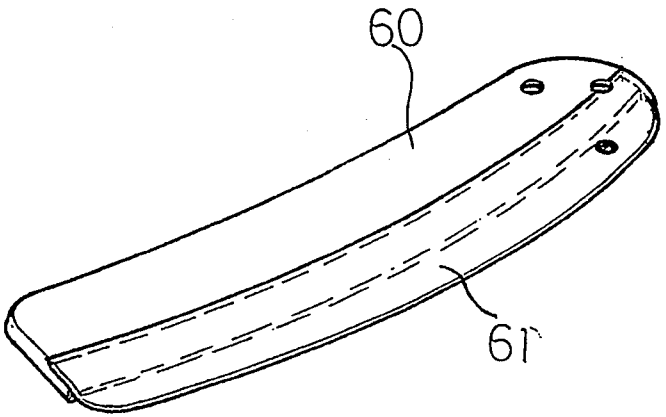
FIGS. 7 and 9 are perspective views of still another applications of the fan blade.
Figure 9:
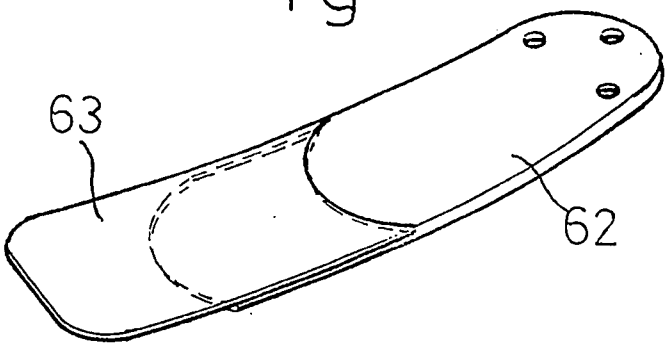
Figure 8:
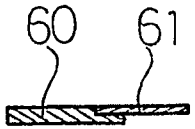
FIGS. 8 and 10 are cross sectional views of the fan blades as shown in FIGS. 7 and 9 respectively.
Figure 10:
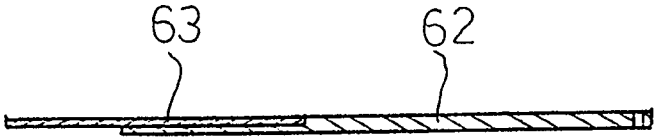

Referring next to FIGS. 7 and 8, the fan blade may include a plate 60 having a shoulder extended in a longitudinal direction thereof, and a board 61 fixed on the plate 60 and engaged with the shoulder of the plate 60 and arranged such that the upper surface of the board 61 is flush with that of the plate 60. Similarly, as shown in FIGS. 9 and 10, the plate 62 may include a shoulder laterally formed therein, and the board 63 is fixed on the plate 62 and is engaged with the shoulder, the upper surface of the board 63 is flush with that of the plate 62.

Figure 11:
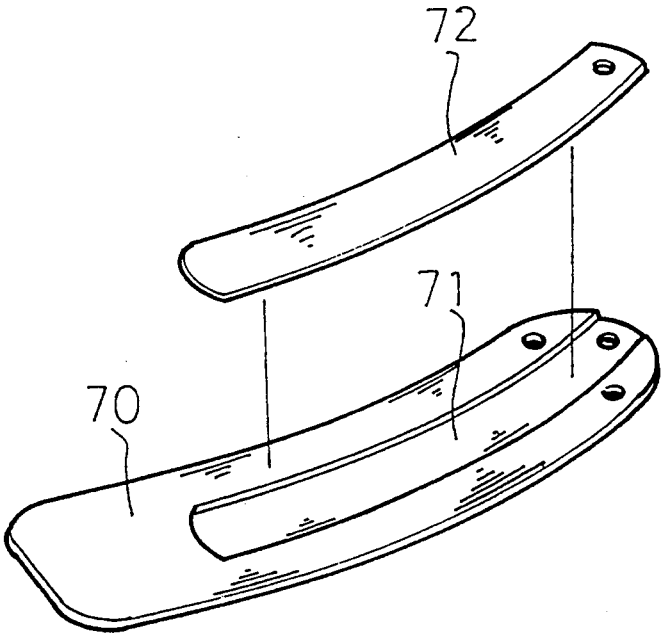
FIG. 11 is an exploded view of a further application of the fan blade.
Figure 12:
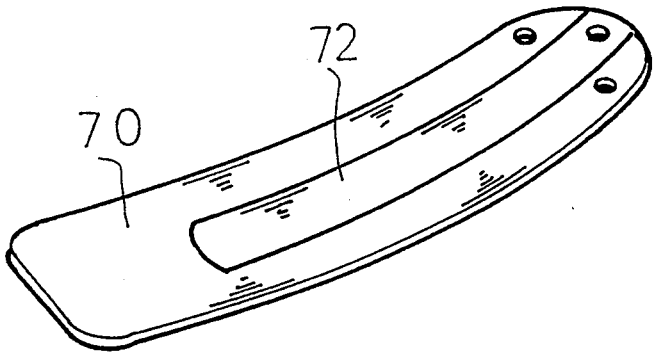
FIG. 12 is a perspective views of the fan blade as shown in FIG. 11.

Referring next to FIGS. 11 and 12, the plate 70 may includes a recess 7I formed therein for engaging with a board 72 which includes a narrower and shorter size than that of the plate 70.

Figure 13:
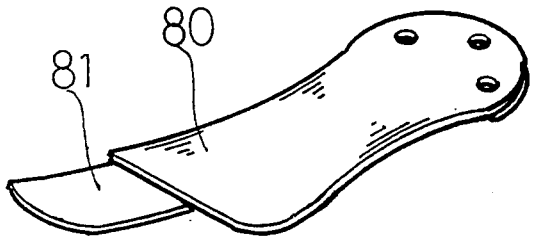
FIG. 13 is a perspective view of another type of the fan blade.

Referring next to FIG. 13, the fan blade may include a plate 81 having a board 80 fixed thereon, no openings are formed in the fan blade.

Accordingly, the fan blade in accordance with the present invention includes an opening formed therein for facilitating air circulation when the fan blade is operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A fan blade configuration comprising a plate, and a board fixed on said plate, and at least one opening formed in said plate and said board for facilitating air circulation when said fan blade is operated, said plate including a first notch formed therein, said board includes a second notch formed therein, said first notch and said second notch forming said opening when said board is fixed on said plate.

* * * * *